United States Patent [19]

Echtler

[11] 4,037,373

[45] July 26, 1977

[54] EARTH ANCHOR

[76] Inventor: Sigmund Echtler, Sickinger Strasse 1, 8000 Munich 50, Germany

[21] Appl. No.: 711,077

[22] Filed: Aug. 2, 1976

[30] Foreign Application Priority Data

Aug. 6, 1975 Germany ..... 2535162

[51] Int. Cl.[2] ..... E02D 5/80

[52] U.S. Cl. ..... 52/127; 52/159; 52/160; 52/742; 85/66; 85/69

[58] Field of Search ..... 52/127, 153–166, 52/704, 742; 85/83, 66, 69, 23; 61/53, 68

[56] References Cited

U.S. PATENT DOCUMENTS

| | | | |
|---|---|---|---|
| 1,118,544 | 11/1914 | Galligan | 85/66 |
| 2,277,956 | 3/1942 | Coffman | 85/83 |
| 2,889,614 | 6/1959 | Seely | 52/155 X |
| 3,012,644 | 12/1961 | Bush | 52/162 |
| 3,417,525 | 12/1968 | Dashio | 52/160 |
| 3,628,337 | 12/1971 | Stepanich | 52/161 X |
| 3,763,655 | 10/1973 | Galuska | 52/158 X |

FOREIGN PATENT DOCUMENTS

| | | | |
|---|---|---|---|
| 231,278 | 5/1909 | Germany | 52/160 |
| 234,455 | 8/1910 | Germany | 52/160 |
| 11,138 | 5/1910 | United Kingdom | 52/160 |

*Primary Examiner*—Leslie A. Braun
*Attorney, Agent, or Firm*—Michael J. Striker

[57] ABSTRACT

An earth anchor comprises an elongated square-section tube formed in its sides with throughgoing longitudinally-spaced slots each of which lies in a respective plane perpendicular to the tube axis. The lower end of the tube is pointed and the upper end is open. A plurality of L-shaped anchor elements are provided in the tube and each have a flat anchored leg slidable transversely in a respective one of the slots and extending generally perpendicularly to the tube and a flat guide leg extending generally parallel to the tube and slidable transversely in the tube on the anchor leg of the underlying anchor element. The lowermost anchor element is slidable on the upper surface of a member constituting the pointed tip of the tube. A tool having a wedge-shaped lower end is pushed down through the tube after the tube has been driven into the ground so as laterally to slide the elements one after the other out of the tube and into the earth surrounding them. Thereafter a holding element such as another tube may be fitted into the interior of the thus-set arrangement in order to hold the anchor elements in their extended position.

10 Claims, 5 Drawing Figures

FIG. 1
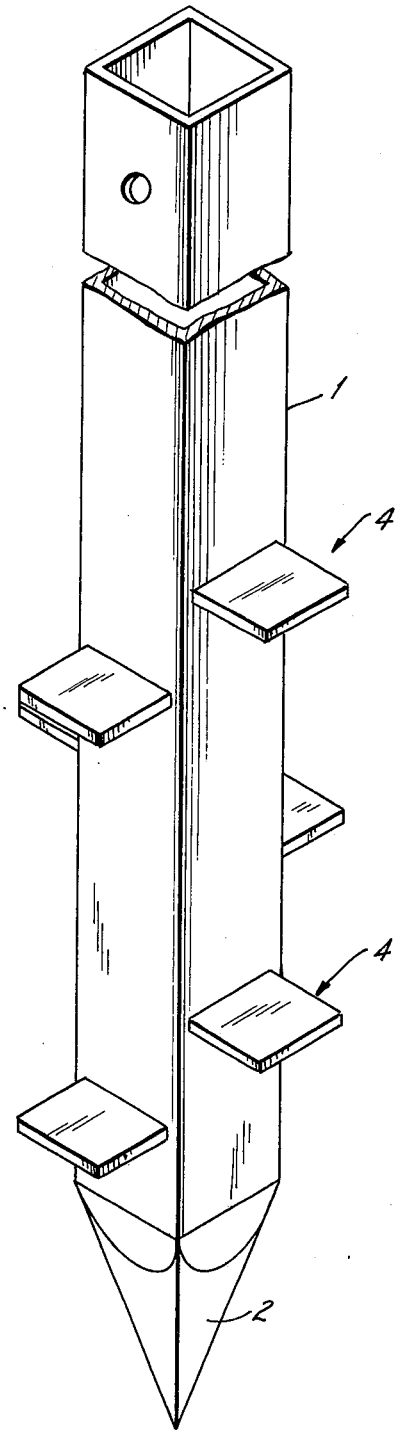
FIG. 4a
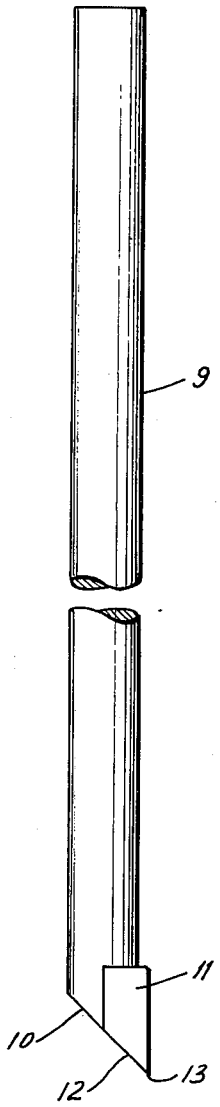
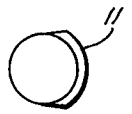
FIG. 4b

EARTH ANCHOR

BACKGROUND OF THE INVENTION

The present invention relates to an earth anchor and a method of setting same. More particularly this invention concerns such an anchor provided with externally extending anchor elements serving to hold the anchor firmly in the ground.

An earth anchor is known which is provided with a plurality of laterally displaceable anchor elements which can be extended outwardly through holes in the side of a tube constituting the main body of the anchor. These elements are displaced laterally outwardly after the anchor tube has been driven into the ground. To this end the lower end of the tube is provided with a point facilitating its driving into the ground and the upper end is set up so as to allow mechanism or a tool to be operated that causes these anchor elements to project laterally from the tube after the tube has been driven into the ground. Normally the anchor elements are longitudinally spaced along the tube and extend radially from the tube in different directions.

In a common such arrangement the tube is provided with a plurality of longitudinally spaced and longitudinally extending slots that lie along a helix around the tube. Pivoted at the upper end of each of these slots is a claw which can be pushed outwardly from the interior of the tube so as to engage in the material in which the anchor is being embedded. To this end a tool is inserted into the open top end of the tube and pushed downwardly toward the point, sequently deflecting the claws upwardly and outwardly into the ground.

Such an arrangement has several disadvantages. First of all the pivot arrangement necessary for each of the claws considerably increases the overall cost of the earth anchor. The claws also must be kept relatively narrow, as if they are made too broad the corresponding slots in the tube will greatly weaken the anchor. Thus, the holding power of these claws in the ground is relatively limited. Finally, the pivoting motion of the claws forms an empty space below each claw once it is fully extended, as the claw swings upwardly compressing the earth it passes through upwardly. Since the claws are invariably actuated sequentially from the top toward the bottom the pivoting-up of these claws will tend to pull the entire tube downwardly in the ground, pulling the uppermost claws away from the earth they have compacted. Thus, the arrangement is not securely anchored in the ground.

It has been suggested to avoid some of these disadvantages by forming the anchor elements as pins extendable generally perpendicularly to the tube and mounted at their inner ends on plates pivoted in the tube about respective axes perpendicular to the tube axis. These plates are pivoted in order to extend the pins by means of a lazy-tongs linkage provided with a pair of oppositely threaded nuts operated by means of a screw passing longitudinally through the center of the tube. Such an arrangement is very expensive to produce. Furthermore the relatively narrow anchor elements provide only a limited purchase in the ground so that the holding power of such an anchor is limited. Since a plurality of such pins can be mounted on a single swingable flap, the lowermost pins are, indeed, longer than the upper pins. Nonetheless due to their limited effective surface area this increased length hardly increases the holding power.

Prior-art earth anchors can be seen in German Pat. Nos. 231,278 and 234,455.

SUMMARY OF THE INVENTION

It is therefore an object of the present invention to provide an improved earth anchor and method of setting same.

Another object is to provide such an anchor which holds very well in the ground, yet which can be produced at low cost.

A further object is the provision of an earth anchor which can be set relatively easily.

These objects are attained according to the present invention in an earth anchor having a polygonal-section anchor tube having a plurality of sides each formed with at least one throughgoing slot extending the full width of the side in a direction perpendicular to the longitudinal axis of the tube, the various slots being spaced longitudinally in a helix along the tube. A plurality of L-shaped anchor elements are provided each having a flat anchor leg slidable transversely in a respective slot and extending generally perpendicularly to the tube, and a flat guide leg extending generally parallel to the tube and slidable transversely in the tube on the anchor leg of the adjacent anchor element. Thus each element is slidable between an inner position with its anchor leg substantially received within the tube and an outer position with its anchor leg projecting laterally from the tube through the respective slot.

According to further features of this invention the tube is of rectangular or quadratic section and the various anchor elements are displaceable from their inner to their outer positions by means of a tool having a wedge-shaped head engageable between the anchor elements and the opposite walls of the tube for displacing these anchor elements into their outer positions. This tool is longitudinally pushed down through the anchor tube after it has been driven into the ground so as to cam the anchor elements laterally outwardly. Since each of these anchor elements is either guided on the underlying element or guided on the member forming the pointed tip of the anchor tube, the anchor legs of these elements move perfectly perpendicularly outwardly relative to the longitudinal axis of the tube.

Since each of these elements is a flat plate which may have a length measured in a direction perpendicular to the respective side and to the longitudinal axis of the tube which is equal to the inner width of the tube between its two sides plus the wall thickness of the tube, a very good purchase of the anchor in the ground is obtained once the anchor elements have been pushed laterally outwardly. Futhermore the structure is so extremely simple that it can be produced at relatively low cost.

According to yet another feature of this invention the anchor tube is fitted after the elements have all been pushed laterally outwardly with a holding member. This holding member may be a tube or the like receivable in a socket formed in the tip member of the tube. The holding member engages between each of the guide legs of the anchor elements and the opposite wall of the tube or the opposite guide elements. It is also possible to fill this holding member with concrete or simply to fill the tube with concrete once the elements have been extended in order permanently to fix the arrangement in place. Such an arrangement insures that the force transmitted to the anchor elements when a pull is exerted on an upper end of the anchor does not simply loosen these elements. Instead the force is exerted virtually in a straight line down along the walls of the anchor tube so that maxium strength is obtained.

According to further features of this invention the corner formed between the two legs of each of the anchor elements is bevelled or formed with a chamfer so that a pointed nose at the tip of the head of the tool used to set the anchor can fit between these corners and the opposite wall of the anchor tube. Thus the tool is pushed downwardly into the top end of the tube after the tube has been driven into the ground and, after each of the anchor elements has been pressed outwardly, this tube is rotated through 90° or an angle corresponding to the angle between adjacent sides of the polygonal-section tube, then is used to press the next anchor element outwardly. To this end the upper end of the tube and of the tool are provided with indicia that readily allow the user to ascertain the proper position of this tool for driving out the anchor elements.

The novel features which are considered as charcteristic for the invention are set forth in particular in the appended claims. The invention itself, however, both as to its construction and its method of operation, together with additional objects and advantages thereof, will be best understood from the following description of a specific embodiment when read in connection with the accompanying drawings.

BRIEF DESCRIPTION OF THE DRAWINGS

FIG. 1 is a perspective view of an anchor according to this invention;

FIG. 4*a* is a side elevational view of the setting tool usable with the anchor of FIGS. 1–3; and FIG. 4*b* is a top view of the tool shown in FIG. 4*a*.

DESCRIPTION OF A PREFERRED EMBODIMENT

Figure 2:
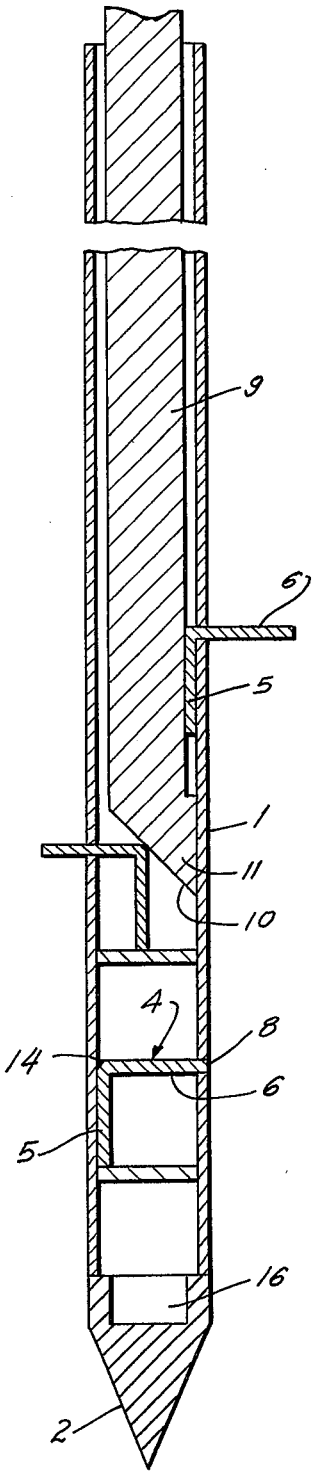
FIGS. 2 and 3 are longitudinal sections through the anchor of this invention during and after its setting in the ground.
Figure 3:
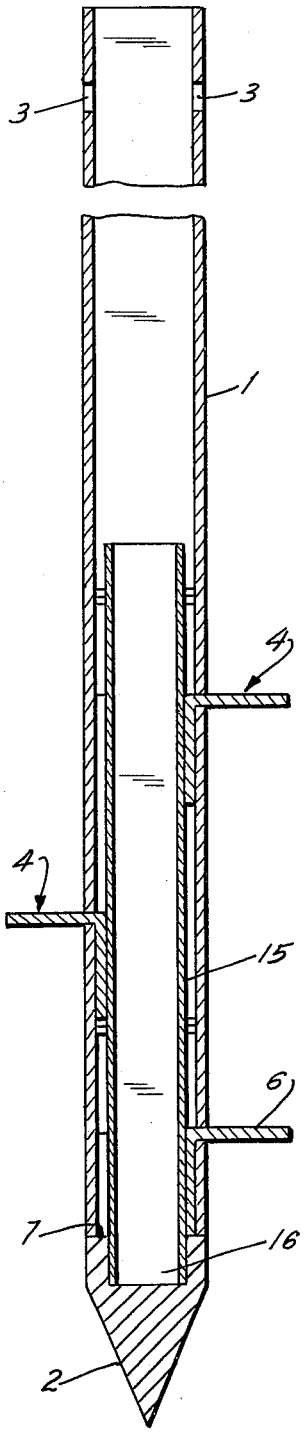

As shown in FIGS. 1–3 an anchor according to the present invention has a hollow tubular shaft 1 of square section. This tube 1 is provided at its lower end with a solid point 2 that is welded in place. Both the point 2 and the tube 1 are preferably made of galvanized steel. At its upper end the tube is provided with laterally throughgoing holes 3 suitable for the attachment of eye bolts, cables, guy wires, or the like to the anchor.

Internally the tube is provided with a plurality, here six, of anchor elements 4, two on two of the sides and one on each of the other two sides. Each of these anchor elements 4 has a guide leg or flange 5 parallel to the longitudinal axis of the tube 1 and an anchor leg or flange 6 perpendicular to the tube 1. These elements 4 are simply formed by bending a rectangular piece of steel into the illustrated L-shape. These elements 4 are spaced longitudinally one above each other so that each flange 6 lies in its own plane. The lower end of each of the flanges 5 of all but the lowermost element 4 is slidable along the upper surface of the underlying flange 6 of the adjacent element 4. The guide flange 5 of the lowermost element 4 is slidable along the upper surface 7 of the point member 2.

The flanges 6 of the element 4 extend laterally through respective slots 8 formed in the respective sides of the square-section tube 1. These holes 8 each extend the full width of the respective side, minus of course a distance equal to twice the wall thickness. In addition these openings 8 lie along a double helix around the tube 1.

The anchor shown in FIGS. 1–3 is set in place by means of a tool illustrated in FIGS. 2, 4*a* and 4*b*. This tube has a circular-section shaft 9 formed with a bevelled lower end on which is provided a laterally extending head 11 having a lower surface 12 in line with the bevelled end 10 and a point 13. After the tube 1 has been driven into the ground with the elements 4 withdrawn into the positions shown for the lower three elements in FIG. 2, the tool is inserted into the upper end of the tube 1 with its head 11 aligned so that the point 13 enters the space between the flange 5 of the uppermost element 4 and the side of the tube 1 opposite the hole 8 through which that element 4 extends. To this end the corner of the element 4 between its flanges 5 and 6 is formed with a chamfer 14. Shaft 9 is then hammered downwardly so that this uppermost element 4 will slide along on the underlying element 4 until the flange 6 extends laterally fully from the tube 1 and the flange 5 lies against the inner surface of the wall of this tube formed with the hole 8 through which this flange 6 extends. Then the tube is rotated through 90° in the direction of the helix formed by the holes 8 and the next element is similarly driven out, again sliding on the underlying element 4. This procedure is repeated for all six of the elements 4 until they all extend laterally outwardly as shown in FIG. 1.

Thereafter as shown in FIG. 3 a tube 15 is fitted down through the tube 1 and into a socket 16 formed in the upper surface 7 of the point member 2. This holding member or tube 15 therefore is braced between the flanges 5 of the elements 4 and prevents their reentry into the interior of this tube 1. The interior of the tube 1 may then be filled with concrete for complete stabilization of the assembly.

Thus with this arrangement it is possible with relatively simple means to set an anchor in the ground which will hold extremely well, much better then any of the prior-art type anchors. At the same time this anchor can be produced at relatively low cost.

It will be understood that each of the elements described above, or two or more together, may also find a useful applicaton in other types of structures differing from the types described above.

While the invention has been illustrated and described as embodied in an earth anchor, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An earth anchor comprising an elongated tube of polygonal section having a plurality of elongated longitudinally extending flat sides at least some of which are each formed with a throughgoing slot spaced longitudinally from the other slots and extending substantially perpendicular to the respective side, said tube having a pointed end and an open end; and a plurality of L-shaped anchor elements each having a flat anchor leg slidable substantially perpendicular to said tube in a respective slot and extending substantially perpendicularly to said tube and a flat guide leg extending substantially parallel to said tube substantially perpendicularly from the respective anchor leg toward said pointed end and slidable substantially perpendicularly in said tube on the anchor leg of the adjacent anchor element, each element being slidable in a direction substantially perpendicular to said tube between an inner position with its anchor leg substantially received within said tube and an outer position with its anchor leg projecting substantially perpendicularly from said tube through the respective slot and with its guide leg lying flatly against the inner surface of the respective side below the respective slot.

2. The anchor defined in claim 1, wherein said slots are each of a length equal substantially to the transverse width of the respective tube side.

3. The anchor defined in claim 2, wherein said tube is of quadratic section.

4. In combination with the anchor of claim 2, a tool longitudinally engageable in said tube past said anchor elements and having a wedge-shaped head engageable with said anchor elements for displacing same from said inner into said outer positions.

5. The anchor defined in claim 2, wherein said slots are substantially longitudinally equispaced along said tube in a helix.

6. The anchor defined in claim 5, wherein said tube has a point member forming said pointed end and the guide leg of the anchor element closest to said point member is slidable thereon, all of the other guide legs being slidable on the anchor leg of the anchor element immediately adjacent in a direction toward said point member.

7. The anchor defined in claim 3, wherein each anchor leg has a length equal substantially to the inner transverse width of said tube between opposite sides plus the wall thickness of said tube.

8. The anchor defined in claim 3, wherein each of said anchor elements is formed with a chamfer at the corner between its legs.

9. The anchor defined in claim 3, further comprising a holding member engageable in said tube with said anchor elements all in said outer position between said guide legs.

10. A method of using an earth anchor comprising an elongated polygonal-section tube having a pointed end, an open end, and a plurality of flat sides each formed with at least one throughgoing slot extending substantially perpendicular to said tube, and a plurality of L-shaped anchor elements each having a flat guide leg and extending substantially perpendicularly from said flat guide leg a flat anchor leg, said method comprising the steps of orienting all of said anchor elements in said tube with their anchor legs engaged in respective slots and extending inside said tube substantially perpendicular to said tube, and with their guide legs extending inside said tube substantially parallel thereto from the respective anchor legs toward said pointed end; supporting the guide leg of that anchor element closest to said pointed end for sliding along a surface substantially perpendicular to said tube; supporting the guide legs of the other anchor elements each on the anchor leg of the closest anchor element in a direction toward said pointed end for sliding thereof substantially perpendicularly to said tube; and thereafter driving a wedge down said tube from said open end and forcing said wedge between each of said anchor elements and the wall opposite the wall having the slot in which the respective anchor element is engaged to slide said anchor elements in a direction substantially perpendicular to said tube from a position substantially completely inside said tube to a position with said anchor legs extending substantially perpendicularly from said tube through the respective slots and with said guide legs lying flatly against the inside surfaces of the respective sides of said tube adjacent the respective slots.

* * * * *